US012566053B2

(12) United States Patent
Chrobak et al.

(10) Patent No.: US 12,566,053 B2
(45) Date of Patent: Mar. 3, 2026

(54) MID-BODY WARHEAD FOR PROJECTILE

(71) Applicant: BAE SYSTEMS Information and Electronic Systems Integration Inc., Nashua, NH (US)

(72) Inventors: Matthew F. Chrobak, Groton, MA (US); Jacob W. Miska, Nashua, NH (US); Jason H. Batchelder, Nashua, NH (US); Ryan Dippel, Arlington, MA (US); Paul A. Reitmeier, Huntsville, AL (US); Michael I. Lacasse, Huntsville, AL (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 75 days.

(21) Appl. No.: 18/426,700

(22) Filed: Jan. 30, 2024

(65) Prior Publication Data

US 2025/0244111 A1 Jul. 31, 2025

(51) Int. Cl.
*F42B 12/32* (2006.01)
*F42B 12/10* (2006.01)

(52) U.S. Cl.
CPC ..... *F42B 12/32* (2013.01); *F42B 12/10* (2013.01)

(58) Field of Classification Search
CPC ..... F42B 12/32; F42B 12/22; F42B 12/24; F42B 12/28; F42B 12/00; F42B 12/02; F42B 12/04; F42B 12/10; F42B 12/105; F42B 12/14; F42B 12/16; F42B 12/18; F42B 12/20; F42B 12/202; F42B 12/201; F42B 12/204; F42B 12/205; F42B 12/207; F42B 12/208
USPC ..... 102/476
See application file for complete search history.

(56) References Cited

U.S. PATENT DOCUMENTS 4,455,943 A * 6/1984 Pinson ..... F42B 12/58 102/393
5,119,730 A * 6/1992 Garnett ..... F42B 12/32 102/496
7,143,698 B2 * 12/2006 Lloyd ..... F42B 12/22 102/497
8,916,810 B2 * 12/2014 Geswender ..... F42B 10/26 244/3.23

(Continued)

OTHER PUBLICATIONS

"Hydra 70," Wikipedia, downloaded from the Internet Jan. 30, 2024 at: https://en.wikipedia.org/wiki/Hyera_70 12 pages.

*Primary Examiner* — John Cooper
(74) *Attorney, Agent, or Firm* — Gary McFaline

(57) ABSTRACT

A warhead includes a casing having a periphery wall that extends along a central axis from a forward end of the casing to a rearward end of the casing. The casing defines a cavity configured to contain an explosive material, wherein the forward end of the casing includes a first thread pattern configured to engage a guidance system casing, and the rearward end of the casing includes a second thread pattern configured to engage a propulsion system casing. A first row of fragments is arranged along a first section of the periphery wall of the casing. A plurality of second rows of fragments is rearward of the first row of fragments and arranged along a second section of the periphery wall of the casing. In an example, each of the first and second sections tapers inward towards the central axis as it extends toward the forward end of the casing.

19 Claims, 8 Drawing Sheets

(56) References Cited

U.S. PATENT DOCUMENTS

| | | | | |
|---|---|---|---|---|
| 9,739,583 | B2 * | 8/2017 | Kerns | F42B 12/207 |
| 9,810,513 | B2 * | 11/2017 | Kerns | F42B 12/204 |
| 11,187,508 | B2 * | 11/2021 | Thuman | F42B 12/32 |
| 12,072,171 | B1 * | 8/2024 | Bonnstetter | F42B 12/24 |
| 2004/0069176 | A1 * | 4/2004 | Kellner | F42B 12/367<br>102/476 |
| 2016/0349027 | A1 * | 12/2016 | Kerns | F42B 33/001 |
| 2021/0041215 | A1 * | 2/2021 | Rastegar | F42B 12/76 |

* cited by examiner

MID-BODY WARHEAD FOR PROJECTILE

FIELD OF DISCLOSURE

The present disclosure relates to a warhead, and more particularly, to a mid-body warhead of a projectile.

BACKGROUND

A warhead is a section of a guided projectile, and contains a payload such as explosive material or reconnaissance equipment. The guided projectile may be, for example, a missile, rocket, torpedo, or other such launchable munition. The warhead is in the forward or nose section of the projectile. The projectile further includes guidance and propulsion systems system rearward of the warhead. The guidance system guides the projectile to a given target, and the propulsion system causes movement of the projectile towards the target.

Figures 1A, 1B:
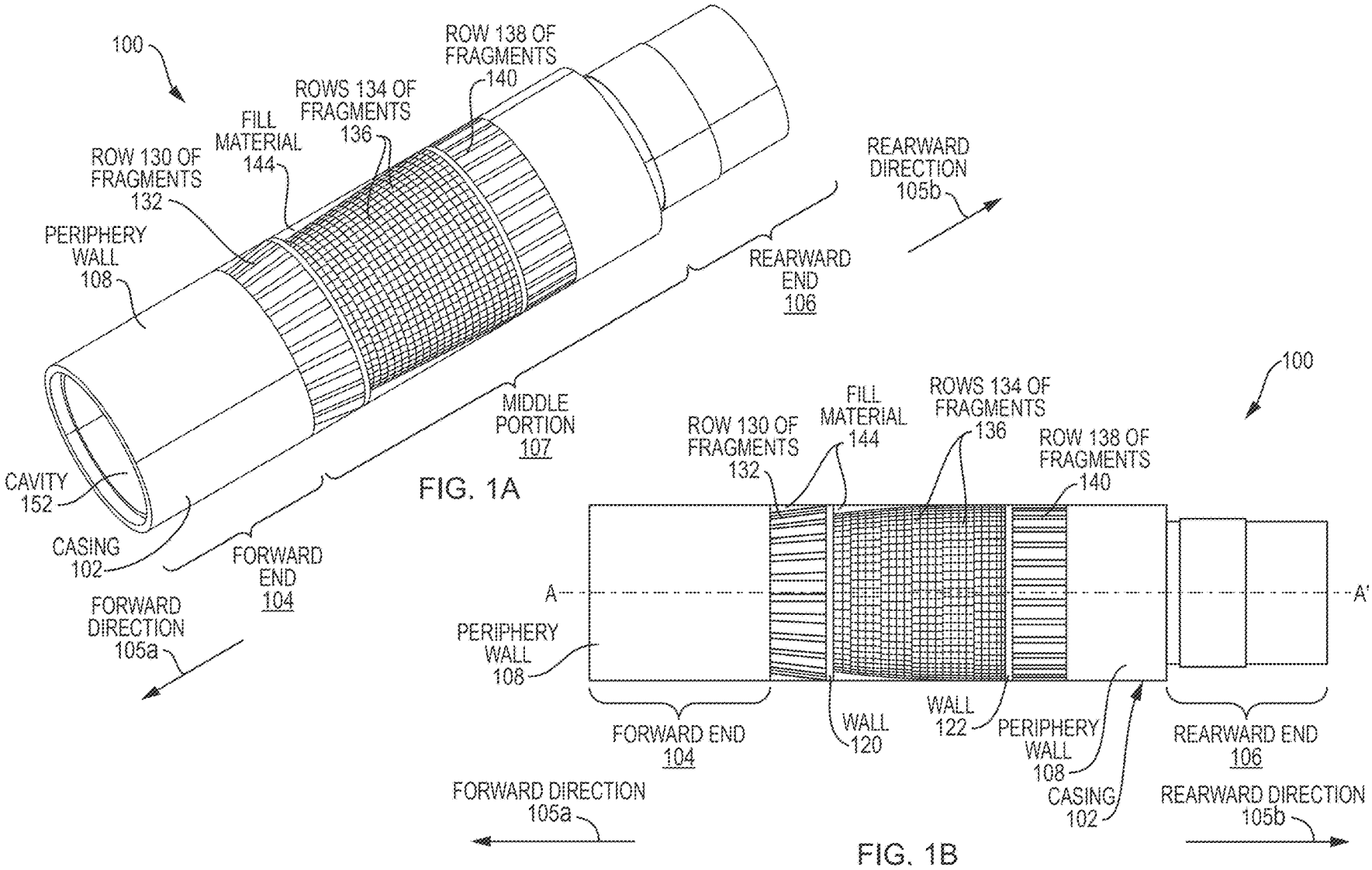
FIGS. 1A and 1B illustrate perspective views of a mid-body warhead, in accordance with an embodiment of the present disclosure.

Although the following detailed description will proceed with reference being made to illustrative examples, many alternatives, modifications, and variations thereof will be apparent in light of this disclosure.

DETAILED DESCRIPTION

Described herein is a warhead of a projectile. The warhead may be used in a number of applications but is particularly useful in the context of a guided munition, where the warhead is deployable between a guidance system and a propulsion system, so as to provide a mid-body warhead configuration. In an example, the warhead includes a casing having a periphery wall that extends from the forward end of the casing to the rearward end of the casing. The casing defines a cavity which may contain an explosive material (such has PBX), wherein the forward end of the casing includes a first thread pattern configured to engage the guidance system casing, and the rearward end of the casing includes a second thread pattern configured to engage the propulsion system casing. A first row of fragments is arranged along a first section of the periphery wall of the casing. A plurality of second rows of fragments is rearward of the first row of fragments and arranged along a second section of the periphery wall of the casing. A third row of fragments is rearward of the second rows of fragments and arranged along a third section of the periphery wall of the casing. The casing may be, for example, a relatively light-weight metal (such as aluminum) having a density that is less than a density of one or more metals of the fragments (such as steel or titanium). In an example configuration, a munition including the warhead comprises a detonator between the cavity and the rearward end of the casing. In some such cases, the explosive material within the cavity is accessible by the detonator via an opening within a rearward facing wall of the casing.

The guidance system (such as a laser beam seeker or dual mode seeker) may be deployed in a forward or nose section of the projectile, and the propulsion system (such as a liquid or solid fuel rocket motor) may be deployed in a rearward section of the projectile, with the warhead laterally between the guidance system and the propulsion system. The warhead may include with a forward facing wall defining a forward wall of the cavity and configured as an explosively formed penetrator (EFP), and uses the blast from the explosive material to direct energy forward to use the EFP and any materials forward of the warhead as additional fragmentation, thus allowing for penetration capability. An EFP is a shaped charge designed to penetrate armor and formed by the effect of an explosive charge on a metal plate. For instance, the forward guidance system is impacted by the EFP, and resulting fragments are expelled in the forward direction. In an example, a projectile including the mid-body warhead is capable of engaging both ground targets and air targets, with penetration capability.

The periphery wall extends along a central axis from the rearward end of the casing to the forward end of the casing. In an example, each of the first and second sections of the periphery wall tapers inward towards the central axis as it extends toward the forward end of the casing. The first, second, and third fragments along the periphery of the warhead may be configured differently. For example, individual ones of the first fragments have a rod-like shape, and individual ones of the second fragments have a spherical, cuboid, or a ball-like shape, and individual ones of the third fragments have a rod-like shape, although other such fragment shapes may be used. In an example, each of the first row, the plurality of second rows, and the third row wraps around an entirety of the periphery wall. In an example, the first, second, and third fragments comprise one or more metals and/or alloys thereof, which may be heavier (e.g., having a higher density) than a metal of the casing. For example, each of the first, second, and third fragments may comprise steel, titanium, or tungsten (e.g., such as the example case of steel rods and tungsten or titanium cubes).

In an example, the cavity may contain an explosive material, such as a plastic bonded explosive (e.g., PBXN-110), although other types of explosives or energetic material may also be used. In an example, the warhead is used in conjunction with a detonation system that comprises a sensor that senses a condition for detonation, and a processor configured to trigger a fuse, based at least in part on an output of the sensor. The fuse, when triggered, timely detonates the explosive material contained within the cavity. The sensor can be, for example, a radio frequency (RF) based proximity sensor configured to sense a proximity of the warhead to a target, although other types of sensors may also be used.

In some examples, the various fragments are bonded in place in their respective sections along the peripheral wall of the mid-body warhead casing, and a sleeve extends around those sections, which may provide further structural rigidity to the warhead, and may firmly secure the fragments in place until detonation. In an example, during detonation of the warhead, the sleeve breaks into pieces and acts as additional fragments, in addition to the various rows of fragments and fill material. In an example, the sleeve comprises titanium, steel, and/or another metal. Numerous configurations and variations will be apparent in light of this disclosure.

Architecture

Figure 1C:
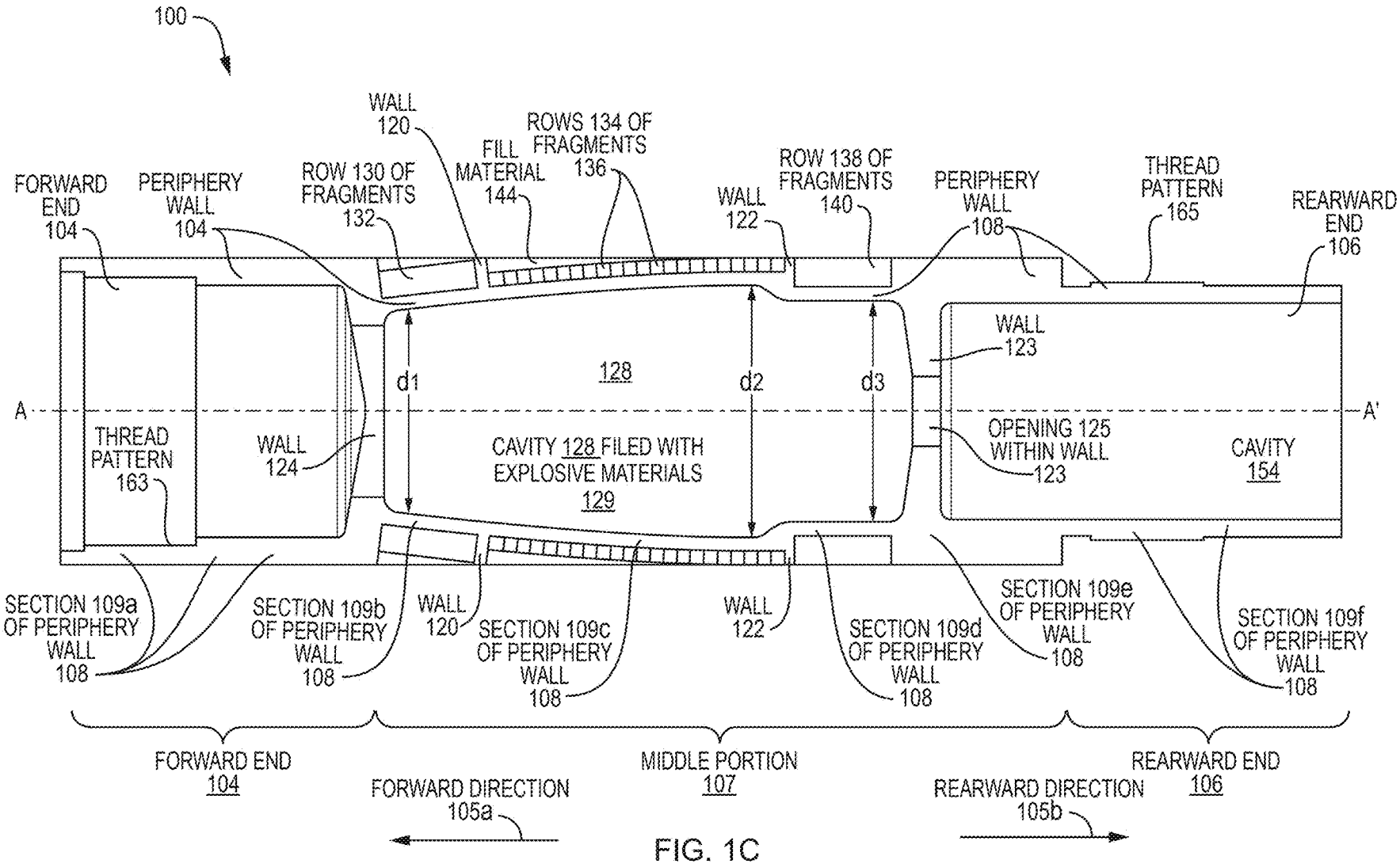
FIGS. 1C and 1D each illustrates a cross-sectional view of a mid-body warhead, in accordance with an embodiment of the present disclosure.

FIGS. 1A, 1B, and 1C schematically illustrate various views of a mid-body warhead 100, in accordance with an embodiment of the present disclosure. FIG. 1A illustrates a perspective view, FIG. 1B illustrates a side view, and FIG. 1C illustrates a cross-sectional view of the warhead 100.

The warhead 100 is referred to specifically as a mid-body warhead, as the warhead 100 is deployable laterally between a guidance system and a propulsion system (such as a rocket), e.g., as described below with respect to FIG. 2. Thus, the warhead 100 is deployable in a mid-portion of a projectile, and hence, referred to herein as a mid-body warhead.

The warhead 100 includes a casing 102. The casing is also referred to herein as a mid-body casing 102, for being in the mid-portion of a body of the projectile. The casing 102 comprises one or more metals and/or alloys thereof. In an example, the casing 102 comprises one or more metals that are relatively light weight and sturdy. In such an example, the casing 102 comprises aluminum, such as 6061-T6 aluminum, although other form of aluminum or another metal may also be used.

FIGS. 1A-1C illustrate a forward end 104, a rearward end 106, and a middle portion 107 of the casing 102. As illustrated, the middle portion 107 is laterally between the forward end 104 and the rearward end 106 of the casing 102. As will be described below with respect to FIG. 2, the forward end 104 is configured to engage a guidance system of a projectile, and the rearward end 106 is configured to engage a propulsion system of the projectile.

A forward direction 105*a* and a rearward direction 105*b* are also labelled in FIGS. 1A-1C. A direction from the middle portion 107 towards the forward end 104 is the forward direction 105*a*, and a direction from the middle portion 107 towards the rearward end 106 is the rearward direction 105*b*. A central axis of the casing 102 is represented by line A-A' in FIGS. 1B and 1C, extends from the forward end 104 to the rearward end 106, and is also referred to herein as central axis A-A'.

The casing 102 comprises a periphery wall 108 that extends along the central axis A-A' from the rearward end 106 of the casing 102 to the forward end 104 of the casing 102. FIG. 1C labels various sections of the periphery wall 108. For example, as labelled in FIG. 1C, a section 109*a* of the periphery wall 108 is on the forward end 104 of the warhead 100; sections 109*b*, 109*c*, 109*d*, 109*e* of the periphery wall 108 are on the middle portion 107 of the warhead 100; and section 109*f* of the periphery wall 108 is on the rearward end 106 of the warhead 100.

In an example, the warhead 100 comprises a plurality of rows of fragments 132, 136, 140 arranged along various sections of the periphery wall 108. For example, a row 130 of fragments 132 is arranged along the section 109*b* of the periphery wall 108. In an example, the fragments 132 have a rod-like shape, although other shapes may be used. As illustrated in FIGS. 1A and 1B, the row 130 of fragments 132 wraps around an entirety of the periphery wall 108.

In an example, the fragments 132 comprise one or more metals and/or alloys thereof. In such an example, the one or more metals of the fragments 132 comprise a metal that is heavier (e.g., having a higher density) than the metal of the casing 102. For example, the fragments 132 comprise steel, although other relatively heavy metal (such as titanium or tungsten) may also be used. Individual fragments 132 are expelled (such as expelled away from the central axis A-A') upon detonation of the warhead 100.

In one embodiment, a plurality of rows 134 of fragments 136 are arranged along the section 109*c* of the periphery wall 108. In an example, individual ones of the fragments 136 has a spherical, cuboid, or a ball-like shape, although other shapes may be used. In an example, each fragment 136 has a diameter or length of about 1.5 to 4.5 mm, such as within 5% or 1% of 3 mm. In an example, there may be about 1000 to 2000 number of fragments 136, such as about 1400 to 1500 number of fragments 136 arranged along the rows 134, although the exact number of such fragments 136 is implementation specific. As illustrated in FIGS. 1A and 1B, the rows 134 of fragments 136 wrap around an entirety of the periphery wall 108. As illustrated, the row 130 of fragments 132 is arranged forward of the rows 134 of fragments 136, and the rows 134 of fragments 136 are arranged rearward of row 130 of fragments 132.

In an example, the fragments 136 comprise one or more metals and/or alloys thereof. In an example, the one or more metals of the fragments 136 comprise a metal that is heavier (e.g., having a higher density) than the metal of the casing 102. For example, the fragments 136 comprise titanium, although other relatively heavy metal (such as steel) may also be used. Individual fragments 136 are expelled (such as expelled away from the central axis A-A') upon detonation of the warhead 100.

In an example, the warhead 100 comprises a row 138 of fragments 140 arranged along the section 109*d* of the periphery wall 108. In an example, the fragments 140 have a rod-like shape, although other shapes may be used. As illustrated in FIGS. 1A and 1B, the row 138 of fragments 140 wraps around an entirety of the periphery wall 108. As illustrated, the row 138 of fragments 140 is arranged rearward of the rows 134 of fragments 136 and the row 130 of fragments 132, such that the rows 134 of fragments 136 are laterally between the row 138 of fragments 140 and the row 130 of fragments 132.

In an example, the fragments 140 comprise one or more metals and/or alloys thereof. In an example, the one or more metals of the fragments 140 comprise a metal that is heavier (e.g., having a higher density) than the metal of the casing 102. In an example, the fragments 140 comprise steel, although other relatively heavy metal (such as titanium) may also be used. Individual fragments 140 are expelled (such as expelled away from the central axis A-A') upon detonation of the warhead 100.

Figure 4A:
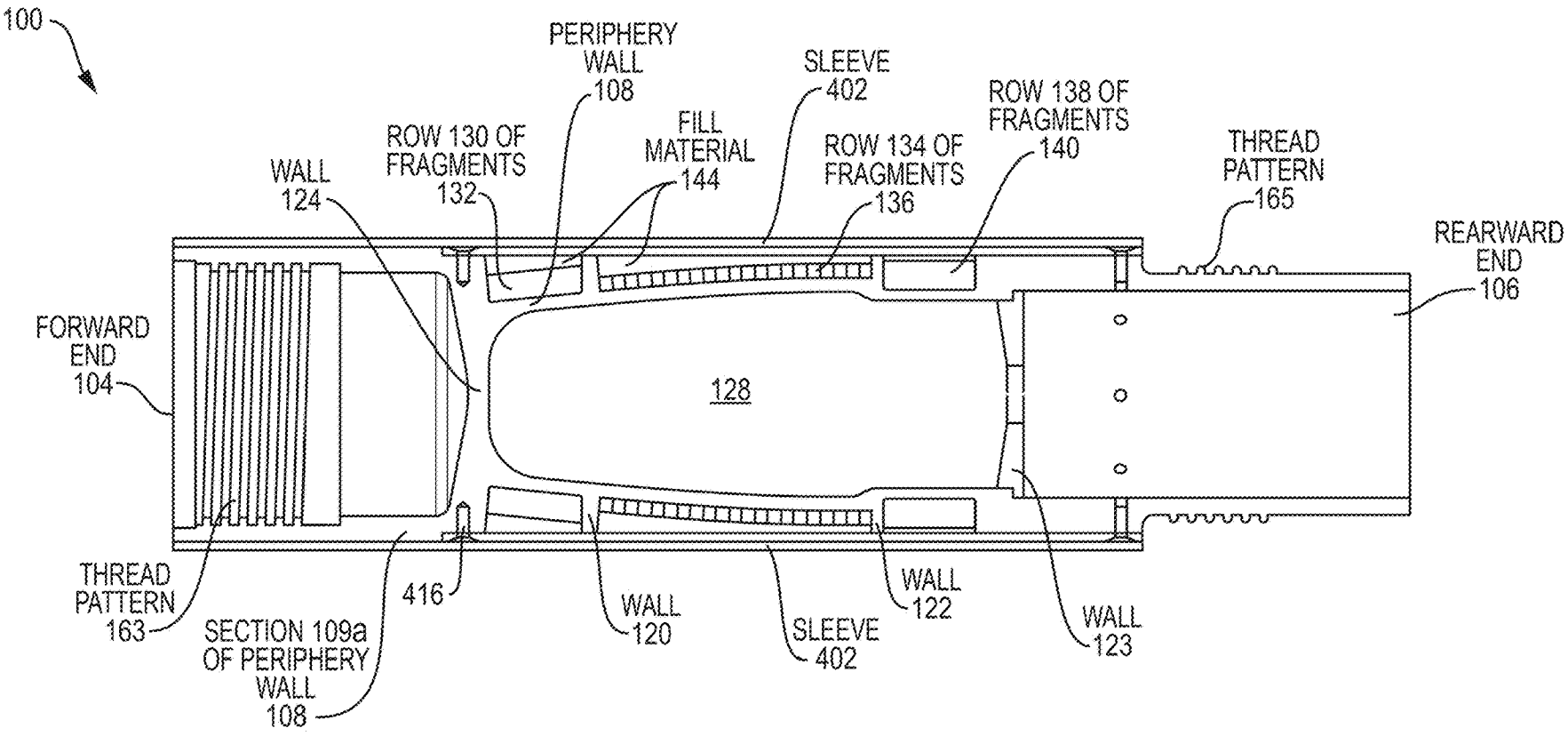
FIGS. 4A, 4B, and 4C illustrate cross-sectional and perspective views of a mid-body warhead, in accordance with an embodiment of the present disclosure.

In one embodiment, the warhead 100 comprises a fill material 144 that fills portions of the sections 109*b*, 109*c*, and/or 109*d* of the periphery wall 108 not occupied by the rows 130, 134, 138 of fragments. In FIG. 1C, the fill material 144 is shown to cover the fragments 132 and at least some of the fragments 136, and not fragments 140. However, in other examples, the fill material 144 may cover all the fragments 132, 136, and 140 (e.g., such as shown in FIG. 4A). The fill material 144 facilitates holding the fragments 132, 136, and 140 in place during flight, while further allowing for fragmentation upon detonation.

An outer circumference of the fill material 144 is flush with an outer circumference of adjacent portions of the periphery wall 108. For instance, in the example shown, the outer circumference of the fill material 144 is flush or coplanar with the outer circumference of the sections 109*a* and/or 109*e* of the periphery wall 108. The fill material 144 may be, for example, an epoxy based fill material, although other bonding agents can be used as well.

As illustrated in FIG. 1C, each of the section 109*c* and the section 109*b* of the peripheral wall 108 tapers inward towards the central axis A-A', as it extends in the forward direction 105*a*. For example, as illustrated in FIG. 1C, an inner diameter of the section 109*b* of the peripheral wall 108 towards the forward end 104 is d1, and an inner diameter of the section 109*c* of the peripheral wall 108 towards the rearward end 106 is d2. In an example, due to the above described tapering, d2 is greater than d1 by at least 1 mm, or at least 2 mm, or at least 5 mm, for example.

The section 109*d* of the peripheral wall is not tapered, in an example, as illustrated in FIG. 1C. However, a junction between the section 109*c* and the section 109*d* is tapered inward towards the central axis A-A', from the section 109*c* to the section 109*d*. Accordingly, an inner diameter of the section 109*d* of the peripheral wall 108 towards the rearward end 106 is d3, where d3 is less than d2 by at least 1 mm, or at least 2 mm, or at least 5 mm, for example.

The sections 109*b*, 109*c*, and 109*d* of the periphery wall 108 define a cavity 128. As illustrated in FIG. 1C, a wall 124 is on the forward direction 105*a* of the cavity 128, and another wall 123 is on the rearward direction 105*b* of the cavity 128. Thus, the periphery wall 108, the wall 124, and the wall 123 fully define the cavity 128. In an example, the cavity 128 is configured to contain an explosive material 129. Any type of explosive material 129 may be used, such as a plastic bonded explosive (PBXN), e.g., PBXN 110, although other types of explosives or energetic material may also be used.

The wall 124 is between the cavity 128 and the forward end 104. In an example and as illustrated in FIG. 1C, the wall 124 has a non-uniform thickness profile, where the thickness is measured in a direction parallel to a length of the casing 102. For example, the wall 124 has a higher thickness near a periphery of the warhead 102 than a thickness of the wall 124 at or near the central axis A-A'. For example, when viewing from the forward end 104 and towards the rearward end 106, a side of the wall 124 has a convex shape. For example, a side of the wall 124 facing the cavity 128 is flat. An opposite side of the wall 124 facing the forward end 104 has a concave shape, such that the thickness of the wall 124 at or near the mid-portion of the wall 124 is less than a thickness of the wall 124 at or near the periphery of the wall 124. The varying thickness profile of the wall 124 results in the wall 124 acting as an explosively formed penetrator (EFP). For example, when the explosive material 129 within the cavity 128 is detonated, the EPF wall 124 deforms into one or more projectiles or fragments that are expelled in the forward direction 105*a*. The guidance system (see FIG. 2) also at least in part breaks due to the fragment(s) from the EPF wall 124. At least part of the fragments from the EPF wall 124 and the guidance system are expelled in the forward direction 105*a*, when the explosive material 129 within the cavity 128 is detonated, in an example.

The wall 123 separates the cavity 128 from the rearward end 106. A part of the section 109*e* and the section 109*f* of the periphery wall 108, along with the wall 123, defines a cavity 154. A part of the cavity 154 is within the rearward end 106 of the casing 102, while another part of the cavity 154 is between the rearward end 106 of the casing 102 and the wall 123. The wall 123 has an opening 125. The opening 125 is at or near the central axis A-A' of the casing 102, as illustrated in FIG. 1C.

Figure 1D:
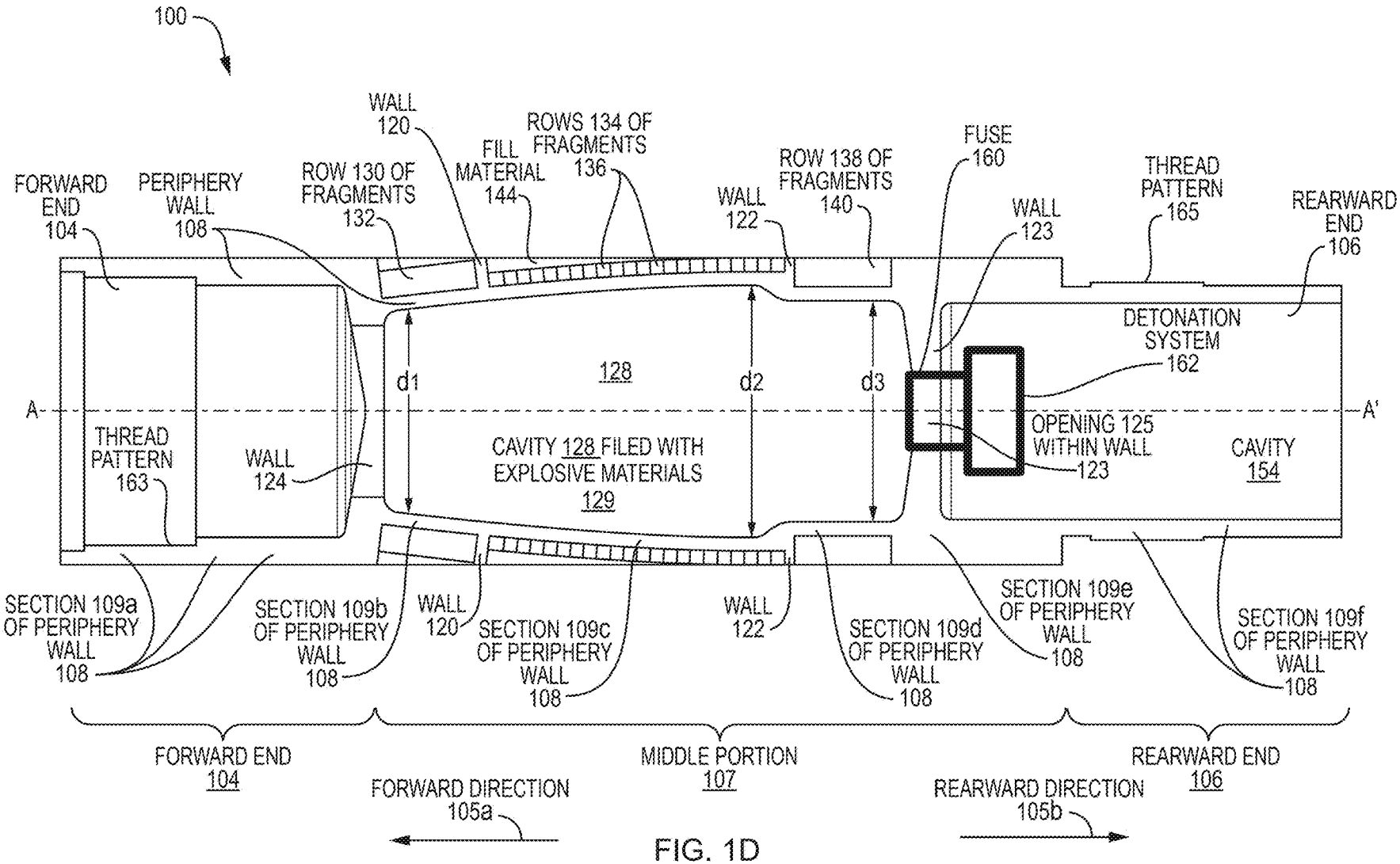

FIG. 1D schematically illustrates an example fuse 160 and a detonation system 162 within the warhead 100 of FIG. 1A-1C, in accordance with an embodiment of the present disclosure. The fuse 160 and a detonation system 162 are illustrated using boxes, e.g., to illustrate locations of these components, and actual shape and/or size of the fuse 160 and the detonation system 162 may be implementation specific.

As illustrated in FIG. 1D, the fuse 160 is at least in part within the opening 125, and is between the cavity 128 and the rearward end 106 of the casing 102. The explosive material 129 within the cavity 128 is accessible by the fuse 160 via the opening 125 within the rearward facing wall 123 of the casing.

The detonation system 162 is proximal to the fuse 160, e.g., between (i) the cavity 128 and the fuse 160 and (ii) the rearward end 106 of the casing 102. In an example, the detonation system 162 comprises a sensor that senses a condition for detonation, and a processor configured to trigger the fuse 160, based at least in part on an output of the sensor. The fuse 160, when triggered, detonates the explosive material 129 contained within the cavity 128.

The sensor is, for example, a radio frequency (RF) based proximity sensor configured to sense a proximity of the warhead 100 to a target. Once the warhead 100 is within a threshold distance from the target, the processor triggers the fuse 160, which in turn detonates the explosive material 129. Other types of sensors may also be used, such as an infrared (IR) based sensor, a sensor to determine if the warhead 100 has hit a target (such as an impact based detonator), a timer that causes detonation after a specified time from launch, a sensor that senses altitude and triggers detonation at a pre-specified altitude, and/or any other type of sensor that senses a condition that results in triggering of the fuse 160.

Referring again to FIGS. 1A-1C, the casing 102 further includes a wall 120 that extends away from the central axis A-A' and is around an entire circumference of the casing 102. Thus, the wall 120 is along a periphery of the casing 102, and fully wraps around the cavity 128. As illustrated in FIG. 1C, the wall 120 doesn't extend within the cavity 128. The wall 120 separates the section 109*b* of the periphery wall 108 and the section 109*c* of the periphery wall 108.

In an example, the wall 120 leans towards the forward end of the casing 102, so as to form an acute angle with respect to the central axis A-A', although other orientations of the wall 120 can be used. Thus, a portion of the wall 120 near a periphery of the warhead 100 is laterally nearer to the forward end 104 than another portion of the wall 120 near the central axis A-A'. Similarly, the portion of the wall 120 near the periphery of the warhead 100 is laterally further from the rearward end 106 than the other portion of the wall 120 near the central axis A-A'.

The casing 102 further includes another wall 122 that extends away from the central axis A-A' and is around an entire circumference of the casing 102. Thus, the wall 122 is along a periphery of the casing 102, and fully wraps around the cavity 128. As illustrated in FIG. 1C, the wall 122 doesn't extend within the cavity 128. The wall 122 separates the section 109*c* of the periphery wall 108 and the section 109*d* of the periphery wall 108.

In an example, the wall 122 forms a substantially right angle with respect to the central axis A-A', e.g., within 88 to 92 degrees with respect to the central axis A-A'. In contrast, the above described wall 120 is at a non-right angle with respect to the central axis A-A' (e.g., an angle that is less than 88 degrees, or less than 85 degrees, for example).

Figure 2:
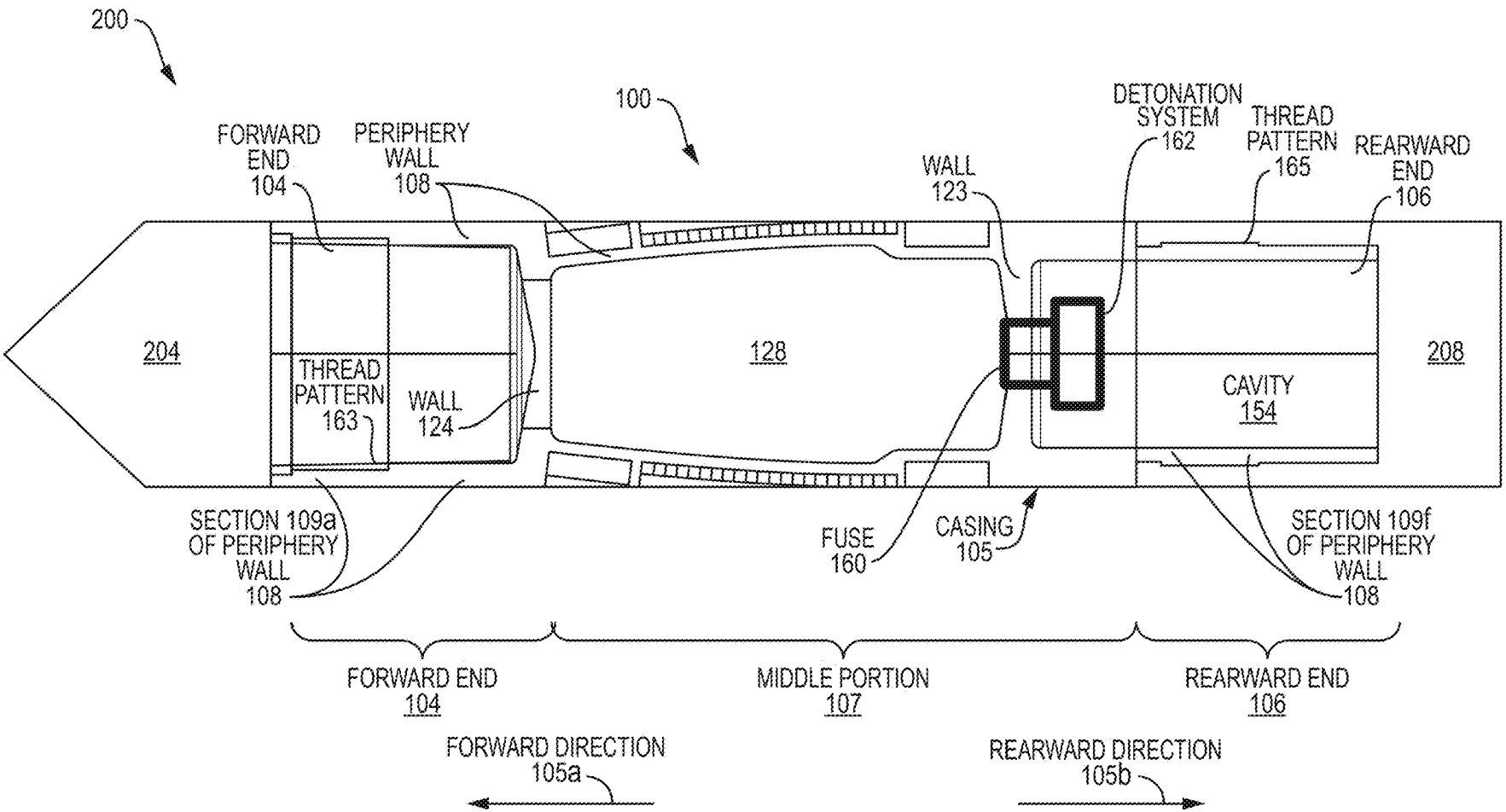
FIG. 2 illustrates a projectile comprising a mid-body warhead, a guidance system forward of the mid-body warhead, and a propulsion system rearward of the mid-body warhead, in accordance with an embodiment of the present disclosure.

FIG. 2 illustrates a projectile 200 comprising the warhead 100 of FIGS. 1A-1D, a guidance system 204 engaged to a forward end 104 of the warhead 100, and a propulsion system 208 engaged to a rearward end 106 of the warhead 100, in accordance with an embodiment of the present disclosure. The guidance system 204 and the propulsion system 208 are schematically illustrated in FIG. 2, without illustrating various components of the guidance system 204 and the propulsion system 208. In an example, the guidance system 204 may be a laser guidance system.

Referring to FIGS. 1C and 2, the forward end 104 comprises a thread pattern 163 on an inward-facing surface of the periphery wall 108, such as the inward-facing surface of the section 109*a* of the periphery wall 108 at the forward end 104 of the casing 102 (the thread pattern 163 is more prominently visible in FIG. 4A). The guidance system 204, such as a guidance system casing of the guidance system 204, is engaged to the thread pattern 163 on the inward-facing surface of the section 109*a* of the periphery wall 108. Thus, at least a part of the guidance system casing of the guidance system 204 is inserted within the forward end 104 of the casing 102.

Figure 4B:
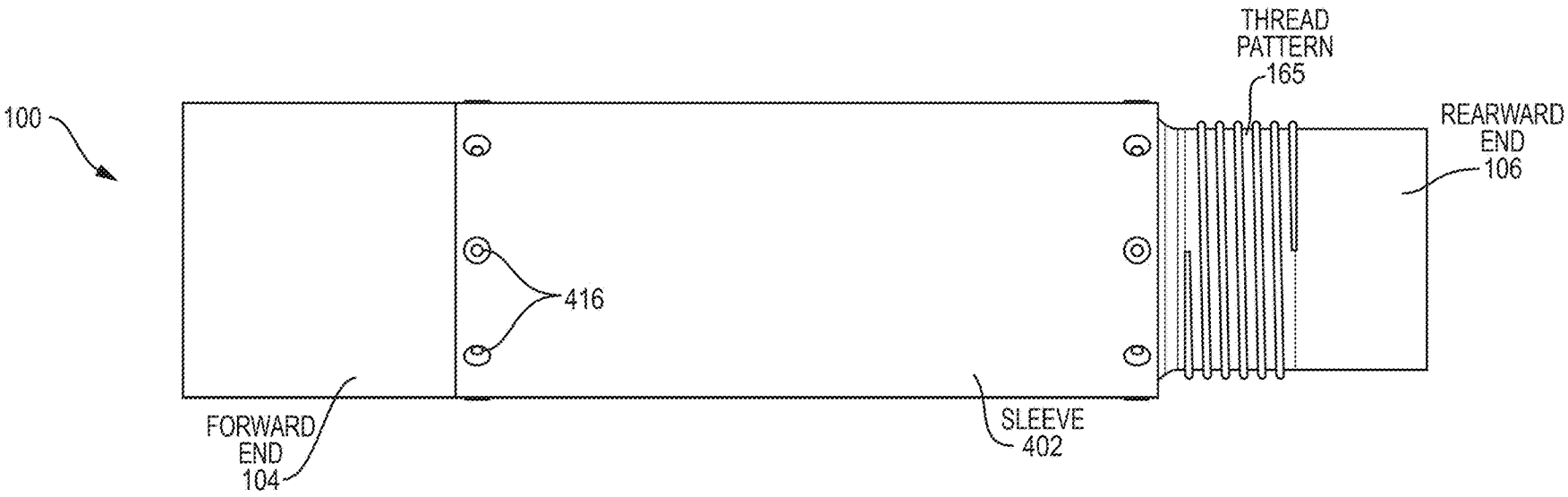
Figure 4C:
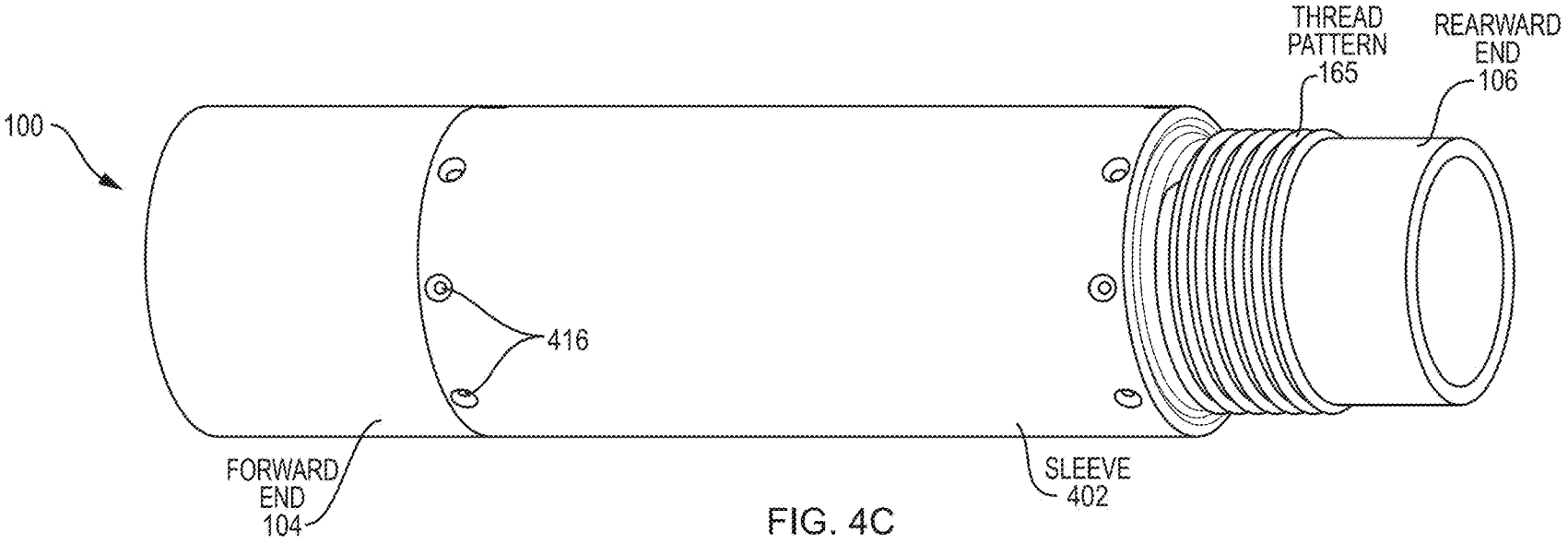

The rearward end 106 comprises a thread pattern 165 on an outward-facing surface of the periphery wall 108, such as the outward-facing surface of the section 109*f* of the periphery wall 108 at the rearward end 106 of the casing 102 (the thread pattern 165 is more prominently visible in FIGS. 4A-4C). The propulsion system 208, such as a rocket, is engaged to the thread pattern 165 on the outward-facing surface of the section 109*f* of the periphery wall 108. Thus, at least a part of the rearward end 106 of the casing 102 is inserted within a propulsion system casing of the propulsion system 208.

Figure 3:
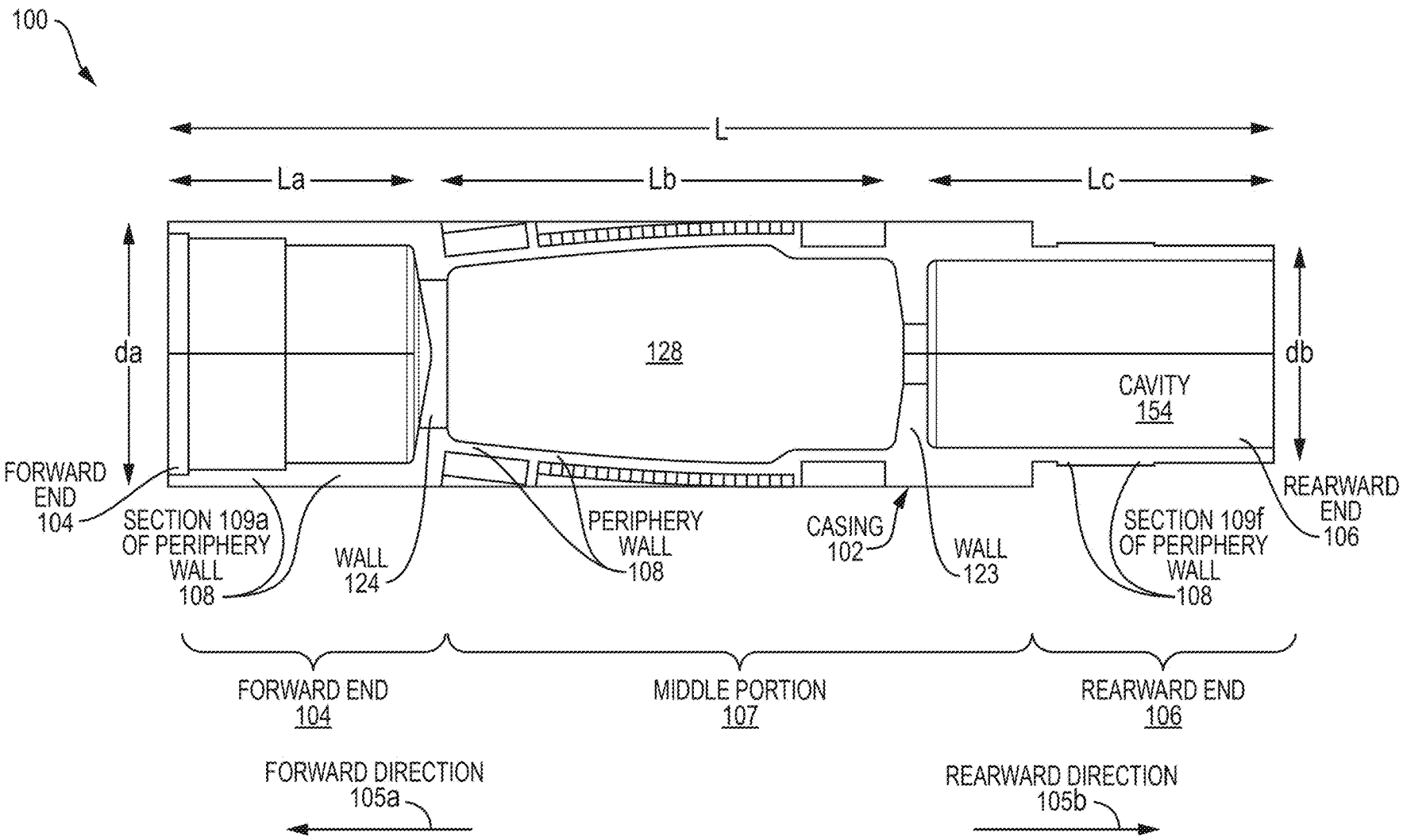
FIG. 3 illustrates example dimensions of a mid-body warhead, in accordance with an embodiment of the present disclosure.

FIG. 3 illustrates example dimensions of various portions of the warhead 100 of FIGS. 1A-2, in accordance with an embodiment of the present disclosure. Such dimensions can vary from one example to the next. In one such example, the dimensions are tailored to an M151 warhead. In such an example, the outermost diameter da is 2.75 inches (70 millimeters), within an acceptable tolerance. As described above with reference to FIG. 2, the forward end 104 has thread patterns 163 on an inside wall and the rearward end 106 has thread patterns 165 on an outside wall, such that the diameter db is less than the outermost diameter da (e.g., 1/32 inches to 1/8 inches less). In this manner, the diameters da and db can be selected such that a guidance system 204 can be threaded into the casing 102 and a propulsion system 208 can be threaded around the casing 102 (e.g., see FIG. 2). As further illustrated in the example of FIG. 3, a minimum outer diameter of the periphery wall 108 is at the rearward end 106 of the casing 102.

Continuing with the example M151 warhead configuration, the forward end 104 of the casing 102, having the section 109*a* of the periphery wall 108, has a length La of about 2.51 inches; a length Lb of the cavity 128 spans from the wall 124 to the wall 123 and is about 4.63 inches; a length Lc of the casing 102 extends from the wall 123 to an end of the rearward end 106 and is about 3.56 inches; and a length L of the entire casing 102 is about 11.39 inches. Each of these example dimensions may have an acceptable tolerance associated therewith (e.g., +/−0.5% or tighter), with the size of the tolerance depending on factors such corresponding or complementary tolerances of the launching platform (e.g., bore of gun barrel or launch tube). Moreover, the dimensions may be changed to accommodate other warhead configurations, whether standard or proprietary. The example dimensions provided are not intended to limit the scope of the techniques described herein.

FIGS. 4A, 4B, and 4C illustrate various views of the warhead 100 of FIGS. 1A-3, with a sleeve 402 on at least a section of a periphery wall of the warhead 100, in accordance with an embodiment of the present disclosure. FIG. 4A is a cross-sectional view, FIG. 4B is a side view, and FIG. 4C is a perspective view of the warhead 100.

As illustrated in FIG. 4A, the fill material 144 is on the fragments 132, 136, and 140. A sleeve 402 in on and around at least sections of the periphery wall 108 of the warhead 100. In the example of FIG. 4A, the sleeve 402 extends from the wall 124 up to the rearward end 106 of the warhead 100, and is not around the rearward end 106.

The sleeve 402 provides structural rigidity to the warhead 100, and firmly secures the fragments 132, 136, and 140 in place. In an example, during detonation of the warhead 100, the sleeve 402 breaks into pieces and acts as additional fragments, in addition to the fragments 132, 136, and 140.

In one embodiment, the sleeve 402 comprises one or more relatively heavy metals and/or alloys thereof (e.g., heavier than a metal of the casing 102), such that the sleeve 402 can act effectively as fragments during detonation. In an example, the sleeve 402 comprises titanium, steel, tungsten, and/or another metal.

In an example, a thickness of the sleeve 402 is relatively less, such that the sleeve 402 explodes into fragments during detonation of the warhead 100. For example, the thickness of the sleeve 402 may be at most 1 mm, or at most 2 mm, or at most 4 mm, or at most 8 mm, or at most 10 mm, or at most 12 mm, or at most 15 mm, or at most 20 mm. In an example, the thickness of the sleeve 402 is less than a thickness of one or more walls of the casing 102, such as one or more of the periphery wall 108, and the walls 124, 120, 122, and/or 123. In an example, the thickness of the sleeve 402 is less than a minimum thickness of various walls of the casing 102.

In one embodiment, the sleeve 402 is attached to the periphery wall 108 through fastening arrangements 416. The fastening arrangements 416 are screws in the example of FIGS. 4A-4C, although the fastening arrangements 416 may include one or more layers of adhesive, hook and loop, magnetic coupling, and/or another fastening arrangement.

Note that the thread patterns 165 on the outward surface of the rearward end 106 and the thread patterns 163 on the inward surface of the forward end 104 of the warhead 100 are better visible in FIGS. 4A-4C, and labelled in these figures.

Figure 5:
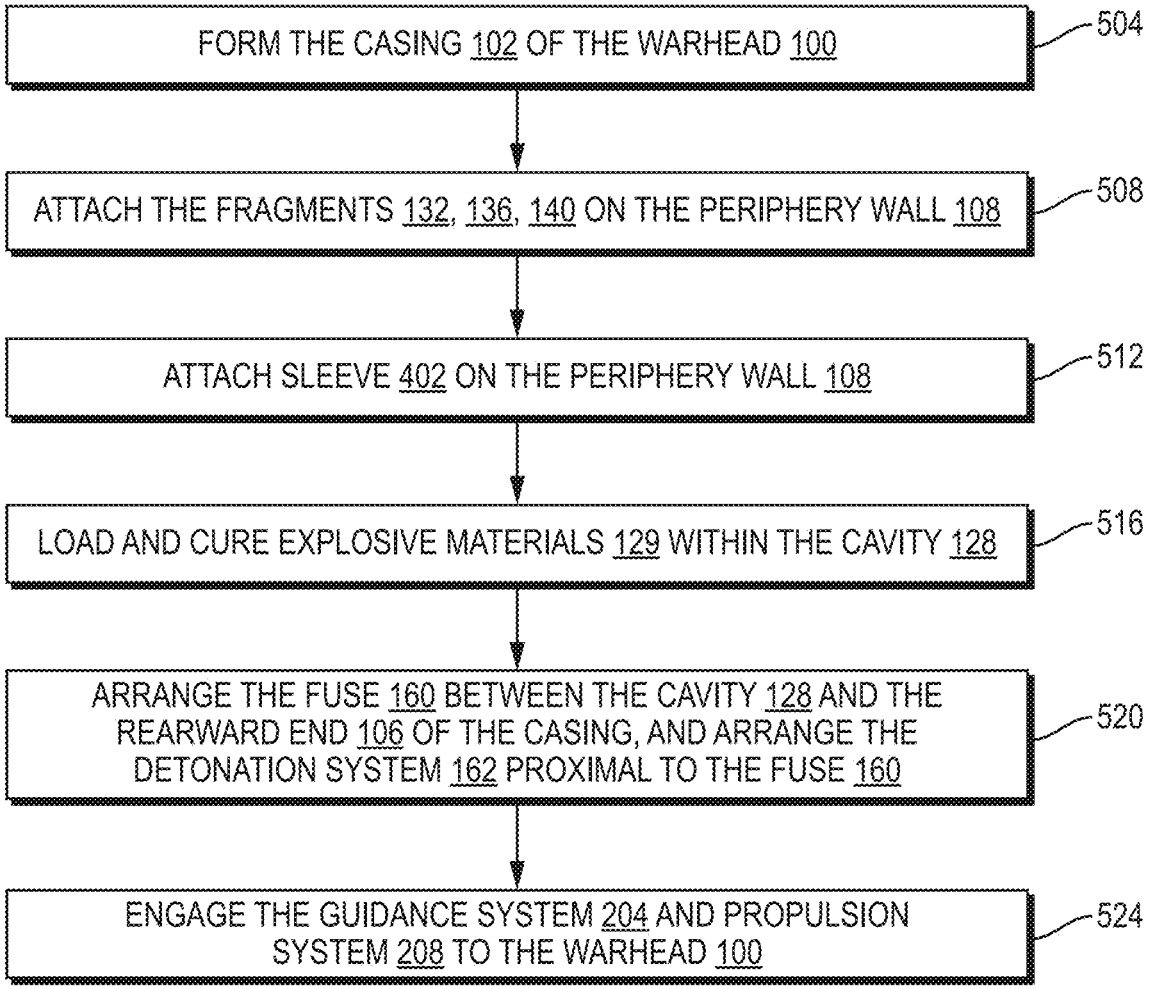

FIG. 5 illustrate a flowchart depicting a method 500 of forming a projectile including a mid-body warhead (such as the warhead 100 of FIGS. 1A-4), in accordance with an embodiment of the present disclosure.

At 504 of method 500, the casing 102 of the warhead 100 is formed, e.g., using manufacturing techniques for forming such a casing. As described above, the casing 102 has a periphery wall 108 that extends from the forward end 104 of the casing 102 to the rearward end 106 of the casing 102. The periphery wall 108, along with a forward facing wall 124 and a rearward facing wall 123, defines the cavity 128 that is configured to contain the explosive material 129, as described above.

At 508 of the method 500, the fragments 132, 136, 140 are arranged on the periphery wall 108, as described above. The fragments 132, 136, 140 are arranged in rows 130, 134, and 138, respectively, as also described above. In an example, the fill material 144 are deposited to at least partially encapsulate the fragments 132, 136, 140, and hold the fragments in place.

The method 500 proceeds from 508 to 512. At 512, the sleeve 402 is attached on the periphery wall 108, e.g., using the fastening arrangements 416, as described above with respect to FIGS. 4A-4C.

The method 500 proceeds from 512 to 516. At 516, explosive material 129 are loaded and cured within the cavity 128. In an example, the explosive material 129 are loaded within the cavity 128 through the opening 125 within the wall 123, and are cured using techniques to cure explosive materials.

The method 500 proceeds from 516 to 520. At 520, the fuse 160 is arranged between the cavity 128 and the rearward end 106 of the casing 102, and the detonation system 162 is arranged proximal to the fuse 160, as described above with respect to FIG. 2. As described above, the explosive material 129 within the cavity 128 is accessible by the fuse 160 via the opening 125 within the rearward facing wall 123 of the casing 102.

The method 500 proceeds from 520 to 524. At 524, the guidance system 204 is engaged to the forward end 104 of the warhead 100, and the propulsion system 208 is engaged to the rearward end 106 of warhead 100, e.g., using corresponding thread patterns 163 and 165, respectively, to form the projectile 200.

Note that the processes in method 500 are shown in a particular order for ease of description. However, one or more of the processes may be performed in a different order or may not be performed at all (and thus be optional), in accordance with some embodiments. For example, the process 512 to attach the sleeve 402 may be optional, and in an example, the warhead 100 may be formed without the sleeve 402. Numerous variations on method 500 and the techniques described herein will be apparent in light of this disclosure.

Further Example Examples

The following examples pertain to further examples, from which numerous permutations and configurations will be apparent.

Example 1. A warhead comprising: a casing having a periphery wall that extends from a forward end of the casing to a rearward end of the casing and defines a cavity configured to contain an explosive material, wherein the forward end of the casing includes a first thread pattern configured to engage a guidance system casing, and the rearward end of the casing includes a second thread pattern configured to engage a propulsion system casing; a first row of fragments arranged along a first section of the periphery wall of the casing; and a plurality of second rows of fragments rearward of the first row of fragments and arranged along a second section of the periphery wall of the casing.

Example 2. The warhead of example 1, wherein the periphery wall extends along a central axis from the rearward end of the casing to the forward end of the casing, and each of the first and second sections of the periphery wall tapers inward towards the central axis as it extends toward the forward end of the casing.

Example 3. The warhead of any one of examples 1-2, comprising a fill material that fills portions of the first and second sections of the periphery wall not occupied by the first and second rows of fragments, so that an outer circumference of the fill material is flush with an outer circumference of a portion of the periphery wall at the forward end of the casing.

Example 4. The warhead of example 3, wherein the fill material comprises an epoxy.

Example 5. The warhead of any one of examples 1-4, wherein: the periphery wall extends along a central axis from the rearward end of the casing to the forward end of the casing, and the first section of the periphery wall is separated from the second section of the periphery wall by a wall that extends away from the central axis and around an entire circumference of the casing.

Example 6. The warhead of example 5, wherein the wall leans towards the forward end of the casing so as to form an acute angle with respect to the central axis.

Example 7. The warhead of any one of examples 1-6, further comprising: a third row of fragments rearward of the second rows of fragments and arranged along a third section of the periphery wall of the casing.

Example 8. The warhead of example 7, wherein: the periphery wall extends along a central axis from the rearward end of the casing to the forward end of the casing; and the second section of the periphery wall is separated from the third section of the periphery wall by a wall that extends away from the central axis and around an entire circumference of the casing.

Example 9. The warhead of example 8, wherein the wall forms a right angle with respect to the central axis.

Example 10. The warhead of any one of examples 7-9, wherein the third section of the periphery wall is not tapered.

Example 11. The warhead of any one of examples 1-10, wherein the first thread pattern is on an inward-facing surface of the periphery wall, and the second thread pattern is on an outward-facing surface of the periphery wall.

Example 12. The warhead of any one of examples 1-11, wherein each of the first row and the second plurality of rows wraps around an entirety of the periphery wall.

Example 13. The warhead of any one of examples 1-12, wherein individual fragments of the first row of fragments have a rod-like shape.

Example 14. The warhead of any one of examples 1-13, wherein individual fragments of the plurality of second row of fragments have a cuboid or spherical shape.

Example 15. The warhead of any one of examples 1-14, wherein the casing comprises a first metal having a density that is less than each of (i) a density of a second metal of the first row of fragments and (ii) a density of a third metal of the plurality of second rows of fragments.

Example 16. The warhead of any one of examples 1-15, wherein the casing comprises aluminum, and each of the first row of fragments and the plurality of second rows of fragments comprises one of steel or titanium.

Example 17. The warhead of any one of examples 1-16, comprising an explosively formed penetrator (EFP) element between the cavity and the forward end of the casing.

Example 18. The warhead of example 17, wherein the EFP element has a non-uniform thickness profile and, responsive to detonation of explosive material within the cavity, causes fragmentation of a guidance system within the guidance system casing coupled to the forward end.

Example 19. The warhead of any one of examples 1-18, comprising a detonator between the cavity and the rearward end of the casing, wherein explosive material within the cavity is accessible by the detonator via an opening within a rearward facing wall of the casing.

Example 20. The warhead of any one of examples 1-19, wherein a maximum diameter of the periphery wall is within 1% of 2.75 inches, and a minimum diameter of the periphery wall is at the rearward end of the casing.

Example 21. The warhead of any one of examples 1-20, further comprising: a sleeve arranged around the first row of fragments and the plurality of second rows of fragments.

Example 22. The warhead of example 21, wherein the sleeve comprises a metal that is denser than a metal of the casing.

Example 23. The warhead of any one of examples 21-22, wherein the sleeve comprises titanium.

Example 24. The warhead of any one of examples 21-23, wherein a thickness of the sleeve is less than a minimum thickness of the casing.

Example 25. A projectile, comprising: the warhead of any one of examples 1-24; a fuse system between the cavity and the rearward end of the casing, wherein explosive material within the cavity is accessible by the fuse system via an opening within a rearward facing wall of the casing; a sensor configured to sense a proximity of the warhead to a target; and a processor configured to trigger the fuse system, based at least in part on an output of the sensor, which in turn detonates explosive material contained within the cavity.

Example 26. A projectile, comprising: the warhead of any one of examples 1-25; a guidance system within the guidance system casing engaged to the first thread pattern of the forward end of the casing; and a propulsion system within the propulsion system casing engaged to the second thread pattern of the rearward end of the casing.

Example 27. A method comprising: forming a casing of a warhead, the casing having a periphery wall that extends from a forward end of the casing to a rearward end of the casing and defines a cavity; arranging (i) a first row of fragments along a first section of the periphery wall of the casing, and (ii) a plurality of second rows of fragments rearward of the first row of fragments and arranged along a second section of the periphery wall of the casing; engaging a guidance system to the forward end of the casing; and engaging a propulsion system to the rearward end of the casing.

Example 28. The method of example 27, wherein the casing includes a first wall that is facing the forward end and a second wall that is facing the rearward end, and wherein the method further comprises: loading an explosive material within the cavity through an opening within the second wall; and curing the explosive material.

Example 29. The method of example 28, further comprising: arranging a fuse and a detonation system between the cavity and the rearward end of the casing, wherein the explosive material within the cavity is accessible by the fuse via the opening within the second wall of the casing.

Example 30. The method of any one of examples 27-29, wherein: the casing comprises (i) a first thread pattern on an inward-facing surface of the forward end of the casing, and (ii) a second thread pattern on an outward-facing surface of the rearward end of casing; engaging the guidance system to the forward end of the casing comprises engaging the guidance system to the first thread pattern; and engaging the propulsion system to the rearward end of the casing comprises engaging the propulsion system to the second thread pattern.

Example 31. A projectile comprising: a warhead comprising (i) a casing having a periphery wall, a first sidewall near a first end of the casing, and a second sidewall near a second end of the casing, wherein the periphery wall, the first sidewall, and the second sidewall define a cavity, (ii) explosive material within the cavity, and (ii) a plurality of rows of fragments on the periphery wall; a fuse system, wherein the explosive material within the cavity is accessible by the fuse system via an opening within the second sidewall; a guidance system engaged to the first end of the casing; and a propulsion system casing engaged to the second end of the casing.

Example 32. The projectile of example 31, comprising an explosively formed penetrator (EFP) element between the cavity and the first end of the casing, wherein the EFP element has a non-uniform thickness profile and, upon a detonation of the explosive material within the cavity, causes fragmentation of the guidance system.

Example 33. The projectile of any one of examples 31-32, wherein: the casing comprises (i) a first thread pattern on an inward-facing surface of the first end of the periphery wall, and (ii) a second thread pattern on an outward-facing surface of the second end of the periphery wall; the guidance system is engaged to the first thread pattern on the first end of the casing; and the propulsion system casing is engaged to the second thread pattern on the second end of the casing.

Numerous specific details have been set forth herein to provide a thorough understanding of the examples. It will be understood, however, that other examples may be practiced without these specific details, or otherwise with a different set of details. It will be further appreciated that the specific structural and functional details disclosed herein are representative of examples and are not necessarily intended to limit the scope of the present disclosure. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims. Furthermore, examples described herein may include other elements and components not specifically described, such as electrical connections, signal transmitters and receivers, processors, or other components for operation of the systems described herein.

The terms and expressions which have been employed herein are used as terms of description and not of limitation, and there is no intention, in the use of such terms and expressions, of excluding any equivalents of the features shown and described (or portions thereof), and it is recognized that various modifications within the scope of the claims can be used. Accordingly, the claims are intended to cover all such equivalents. Various features, aspects, and examples have been described herein. The features, aspects, and examples are susceptible to combination with one another as well as to variation and modification, as will be appreciated in light of this disclosure. The present disclosure should, therefore, be considered to encompass such combinations, variations, and modifications. It is intended that the scope of the present disclosure be limited not by this detailed description, but rather by the claims appended hereto. Future filed applications claiming priority to this application may claim the disclosed subject matter in a different manner and may generally include any set of one or more elements as variously disclosed or otherwise demonstrated herein.

What is claimed is:

1. A warhead comprising:

a casing having a periphery wall that extends from a forward end of the casing to a rearward end of the casing and defines a cavity configured to contain an explosive material, wherein the forward end of the casing includes a first thread pattern configured to engage a guidance system casing, and the rearward end of the casing includes a second thread pattern configured to engage a propulsion system casing;

a first row of fragments arranged along a first section of the periphery wall of the casing;

a plurality of second rows of fragments rearward of the first row of fragments and arranged along a second section of the periphery wall of the casing; and a sleeve arranged around the first row of fragments and the plurality of second rows of fragments, wherein the sleeve comprises a metal that is denser than a metal of the casing.

2. The warhead of claim 1, wherein the periphery wall extends along a central axis from the rearward end of the casing to the forward end of the casing, and each of the first and second sections of the periphery wall tapers inward towards the central axis as it extends toward the forward end of the casing.

3. The warhead of claim 1, comprising a fill material that fills portions of the first and second sections of the periphery wall not occupied by the first and second rows of fragments, so that an outer circumference of the fill material is flush with an outer circumference of a portion of the periphery wall at the forward end of the casing.

4. The warhead of claim 1, wherein:

the periphery wall extends along a central axis from the rearward end of the casing to the forward end of the casing, and the first section of the periphery wall is separated from the second section of the periphery wall by a wall that extends away from the central axis and around an entire circumference of the casing.

5. The warhead of claim 1, wherein the first thread pattern is on an inward-facing surface of the periphery wall, and the second thread pattern is on an outward-facing surface of the periphery wall.

6. The warhead of claim 1, wherein each of the first row and the second plurality of rows wraps around an entirety of the periphery wall.

7. The warhead of claim 1, wherein the casing comprises a first metal having a density that is less than each of (i) a density of a second metal of the first row of fragments and (ii) a density of a third metal of the plurality of second rows of fragments.

8. The warhead of claim 1, comprising an explosively formed penetrator (EFP) element between the cavity and the forward end of the casing.

9. The warhead of claim 1, wherein the sleeve comprises titanium.

10. The warhead of claim 1, further comprising:

a third row of fragments rearward of the second rows of fragments and arranged along a third section of the periphery wall of the casing.

11. The warhead of claim 10, wherein:

the periphery wall extends along a central axis from the rearward end of the casing to the forward end of the casing; and the second section of the periphery wall is separated from the third section of the periphery wall by a wall that extends away from the central axis and around an entire circumference of the casing.

12. A projectile, comprising:

the warhead of claim 1;

a fuse system between the cavity and the rearward end of the casing, wherein explosive material within the cavity is accessible by the fuse system via an opening within a rearward facing wall of the casing;

a sensor configured to sense a proximity of the warhead to a target; and a processor configured to trigger the fuse system, based at least in part on an output of the sensor, which in turn detonates explosive material contained within the cavity.

13. A projectile, comprising:

the warhead of claim 1;

a guidance system within the guidance system casing engaged to the first thread pattern of the forward end of the casing; and a propulsion system within the propulsion system casing engaged to the second thread pattern of the rearward end of the casing.

14. A method comprising:

forming a casing of a warhead, the casing having a periphery wall that extends from a forward end of the casing to a rearward end of the casing and defines a cavity;

arranging (i) a first row of fragments along a first section of the periphery wall of the casing, and (ii) a plurality of second rows of fragments rearward of the first row of fragments and arranged along a second section of the periphery wall of the casing;

arranging a sleeve around the first row of fragments and the plurality of second rows of fragments, wherein the sleeve comprises a metal that is denser than a metal of the casing engaging a guidance system to the forward end of the casing; and engaging a propulsion system to the rearward end of the casing.

15. The method of claim 14, wherein the casing includes a first wall that is facing the forward end and a second wall that is facing the rearward end, and wherein the method further comprises:

loading an explosive material within the cavity through an opening within the second wall; and arranging a fuse and a detonation system between the cavity and the rearward end of the casing, wherein the explosive material within the cavity is accessible by the fuse via the opening within the second wall of the casing.

16. The method of claim 14, wherein:

the casing comprises (i) a first thread pattern on an inward-facing surface of the forward end of the casing, and (ii) a second thread pattern on an outward-facing surface of the rearward end of casing;

engaging the guidance system to the forward end of the casing comprises engaging the guidance system to the first thread pattern; and engaging the propulsion system to the rearward end of the casing comprises engaging the propulsion system to the second thread pattern.

17. A projectile comprising:

a warhead comprising (i) a casing having a periphery wall, a first sidewall near a first end of the casing, and a second sidewall near a second end of the casing, wherein the periphery wall, the first sidewall, and the second sidewall define a cavity, (ii) explosive material within the cavity, and (ii) a plurality of rows of fragments on the periphery wall;

a fuse system, wherein the explosive material within the cavity is accessible by the fuse system via an opening within the second sidewall;

a guidance system engaged to the first end of the casing; and a propulsion system casing engaged to the second end of the casing; and a sleeve arranged around the first row of fragments and the plurality of second rows of fragments, wherein the sleeve comprises a metal that is denser than a metal of the casing.

18. The projectile of claim 17, comprising an explosively formed penetrator (EFP) element between the cavity and the first end of the casing, wherein the EFP element has a non-uniform thickness profile and, responsive to detonation of the explosive material within the cavity, causes fragmentation of the guidance system.

19. The projectile of claim 18, wherein:

the casing comprises (i) a first thread pattern on an inward-facing surface of the first end of the periphery wall, and (ii) a second thread pattern on an outward-facing surface of the second end of the periphery wall;

the guidance system is engaged to the first thread pattern on the first end of the casing; and the propulsion system casing is engaged to the second thread pattern on the second end of the casing.

* * * * *